US007832411B2

(12) United States Patent
Draghetti

(10) Patent No.: US 7,832,411 B2
(45) Date of Patent: Nov. 16, 2010

(54) CIGARETTE MANUFACTURING METHOD

(75) Inventor: Fiorenzo Draghetti, Medicina (IT)

(73) Assignee: G. D Societa'per Azioni, Bologna (IT)

( * ) Notice: Subject to any disclaimer, the term of this patent is extended or adjusted under 35 U.S.C. 154(b) by 1274 days.

(21) Appl. No.: 10/547,649

(22) PCT Filed: Aug. 20, 2003

(86) PCT No.: PCT/EP03/50383

§ 371 (c)(1),
(2), (4) Date: Mar. 22, 2006

(87) PCT Pub. No.: WO2004/077970

PCT Pub. Date: Sep. 16, 2004

(65) Prior Publication Data

US 2006/0225748 A1 Oct. 12, 2006

(30) Foreign Application Priority Data

Mar. 6, 2003 (IT) ..... BO2003A0124

(51) Int. Cl.
*A24C 5/32* (2006.01)
*A24C 5/34* (2006.01)

(52) U.S. Cl. ..... 131/280; 131/109.1; 131/108; 131/110; 131/84.3

(58) Field of Classification Search ..... None
See application file for complete search history.

(56) References Cited

U.S. PATENT DOCUMENTS

| | | | | |
|---|---|---|---|---|
| 3,624,748 | A | 11/1971 | Strydom | |
| 3,871,385 | A | 3/1975 | David | |
| 3,881,498 | A * | 5/1975 | Wochnowski | 131/302 |
| 4,442,848 | A * | 4/1984 | Seragnoli | 131/108 |
| 4,889,138 | A * | 12/1989 | Heitmann et al. | 131/84.1 |

FOREIGN PATENT DOCUMENTS

| | | |
|---|---|---|
| DE | 496 801 | 4/1930 |
| GB | 955846 | 4/1964 |

* cited by examiner

*Primary Examiner*—Philip C Tucker
*Assistant Examiner*—Phu H Nguyen
(74) *Attorney, Agent, or Firm*—Ladas & Parry LLP

(57) ABSTRACT

A cigarette manufacturing method and machine, whereby a shredded tobacco stream is fed along a channel extending through at least one carding unit and having at least one output portion closed by a suction conveyor belt and for feeding a mat of tobacco onto the suction conveyor belt; and the shredded tobacco stream is cleaned, upstream from the carding unit, to remove relatively heavy parts, such as lumps of tobacco and/or woody tobacco parts and/or any foreign bodies, from the shredded tobacco stream.

5 Claims, 4 Drawing Sheets

CIGARETTE MANUFACTURING METHOD

TECHNICAL FIELD

The present invention relates to a cigarette manufacturing method and machine.

BACKGROUND ART

In cigarette manufacturing machines, shredded tobacco is normally fed via an input hopper to a gravity channel connected via a carding unit to a basin, from which extends upwards an upflow channel closed at the top end by a conveyor belt permeable to air. In the upflow channel, an upward air current, at least partly produced by suction through the conveyor belt, draws up the light part of the tobacco comprising powder and relatively minute shreds, while any heavier parts, such as lumps, woody parts, or foreign bodies (stones and similar) fall by gravity into the basin and are rejected.

Though widely used and relatively effective, the above method may result in problems caused by the heavier parts, particularly the foreign bodies, damaging the carding unit.

DISCLOSURE OF INVENTION

It is an object of the present invention to provide a cigarette manufacturing method and machine designed to eliminate the aforementioned drawback, and which are cheap and easy to implement.

According to the present invention, there is provided a cigarette manufacturing method as claimed in claim 1 and, preferably, in any one of the following Claims depending directly or indirectly on claim 1.

According to the present invention, there is also provided a cigarette manufacturing machine.

BRIEF DESCRIPTION OF THE DRAWINGS

A number of non-limiting embodiments of the present invention will be described by way of example with reference to the accompanying drawings, in which.

BEST MODE FOR CARRYING OUT THE INVENTION

Figure 1:
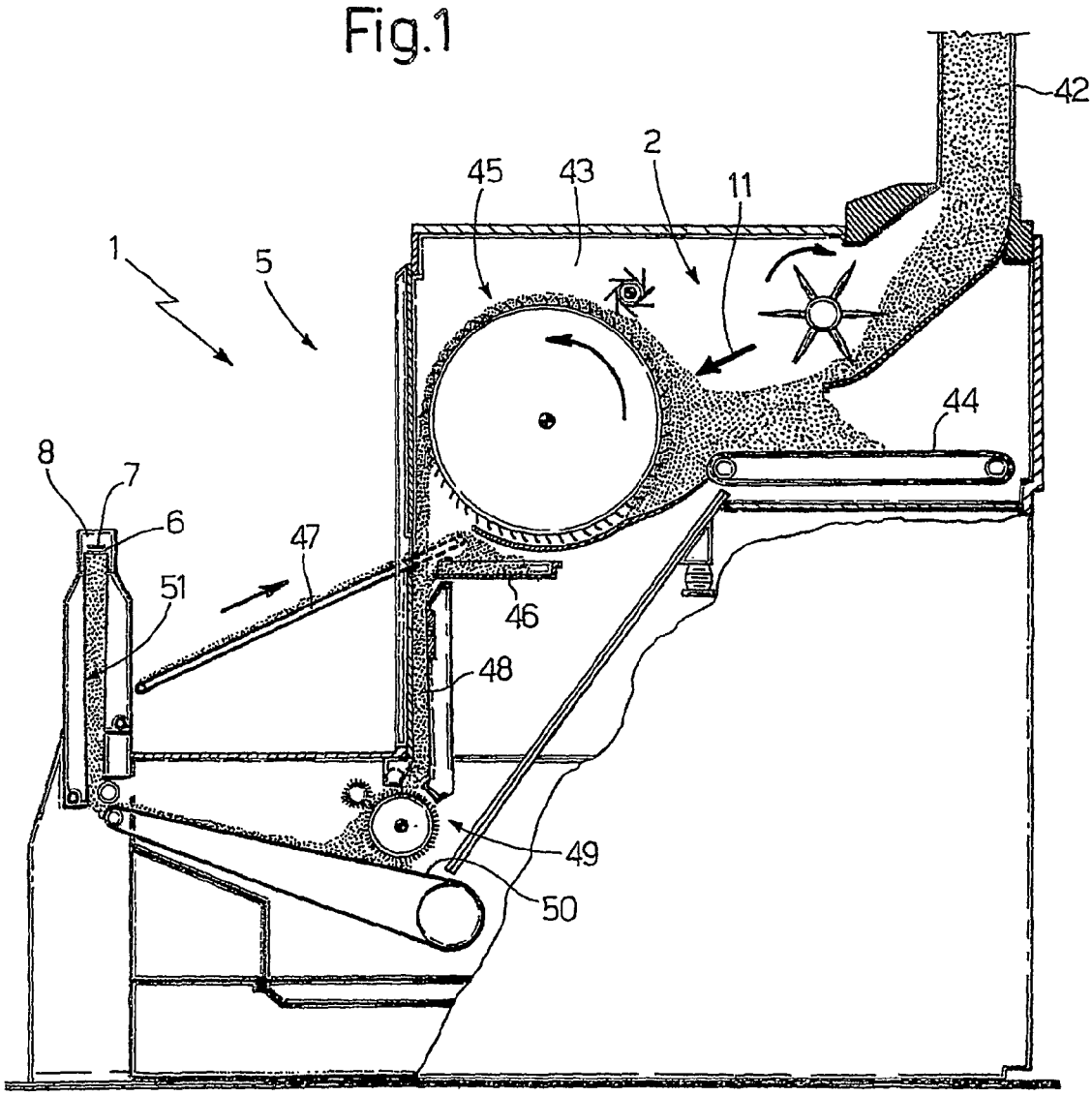
FIG. 1 shows a side view, with parts in section and parts removed for clarity, of a first portion of a preferred embodiment of the manufacturing machine according to the present invention.
Figure 2:
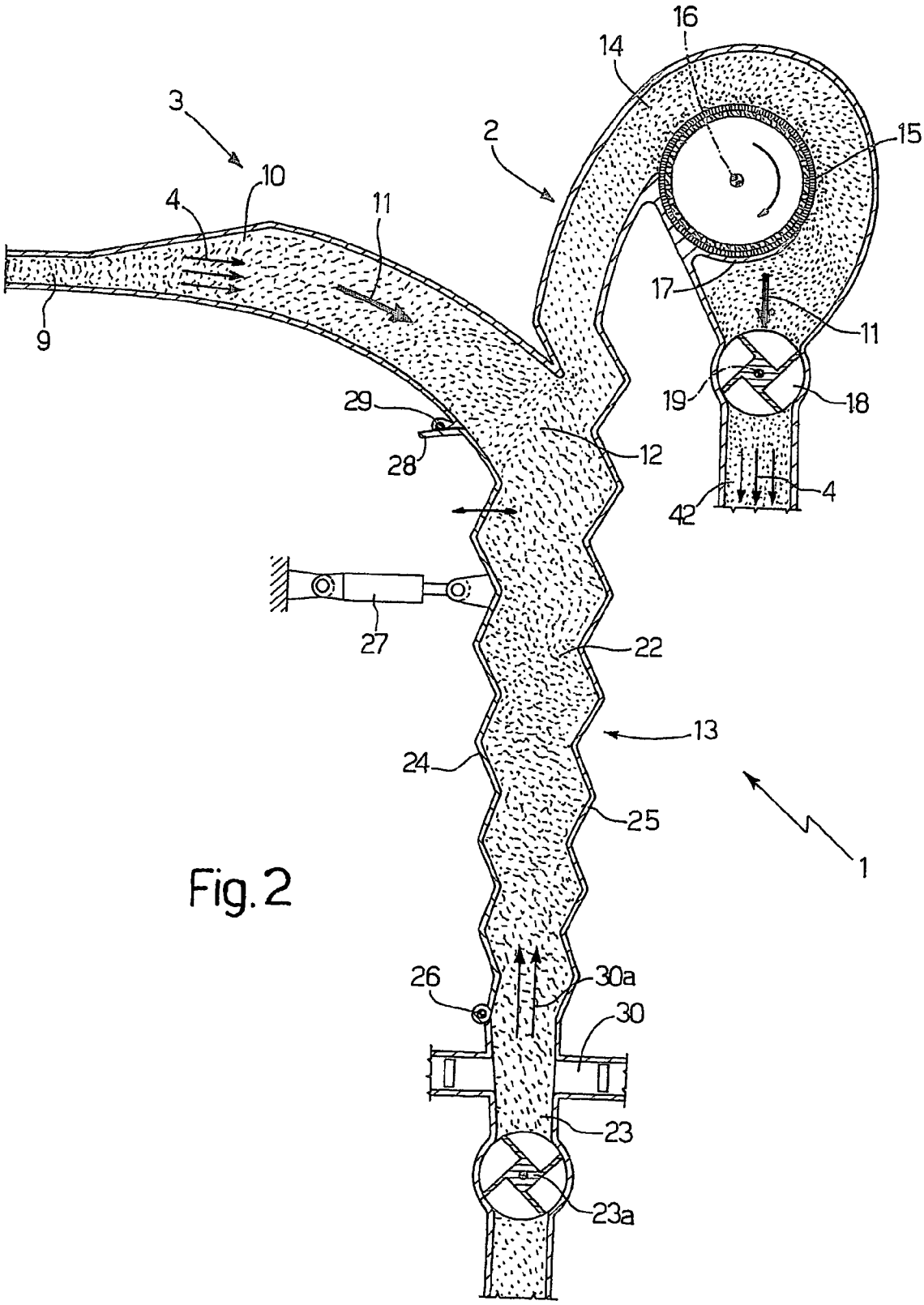
FIG. 2 shows a section, with parts removed for clarity, of a second portion of the FIG. 1 manufacturing machine.

Number 1 in FIGS. 1 and 2 indicates as a whole a cigarette manufacturing machine comprising a channel 2 extending through an input unit 3 (FIG. 2) for supplying a shredded tobacco stream 4; and a manipulating unit 5 (FIG. 1) for receiving shredded tobacco stream 4 from input unit 3, and for forming a mat 6 of shredded tobacco on the bottom surface of a conveyor belt 7, which is made of material permeable to air, and runs directly beneath a suction box 8 for retaining mat 6 on conveyor belt 7 by suction.

Figure 3:
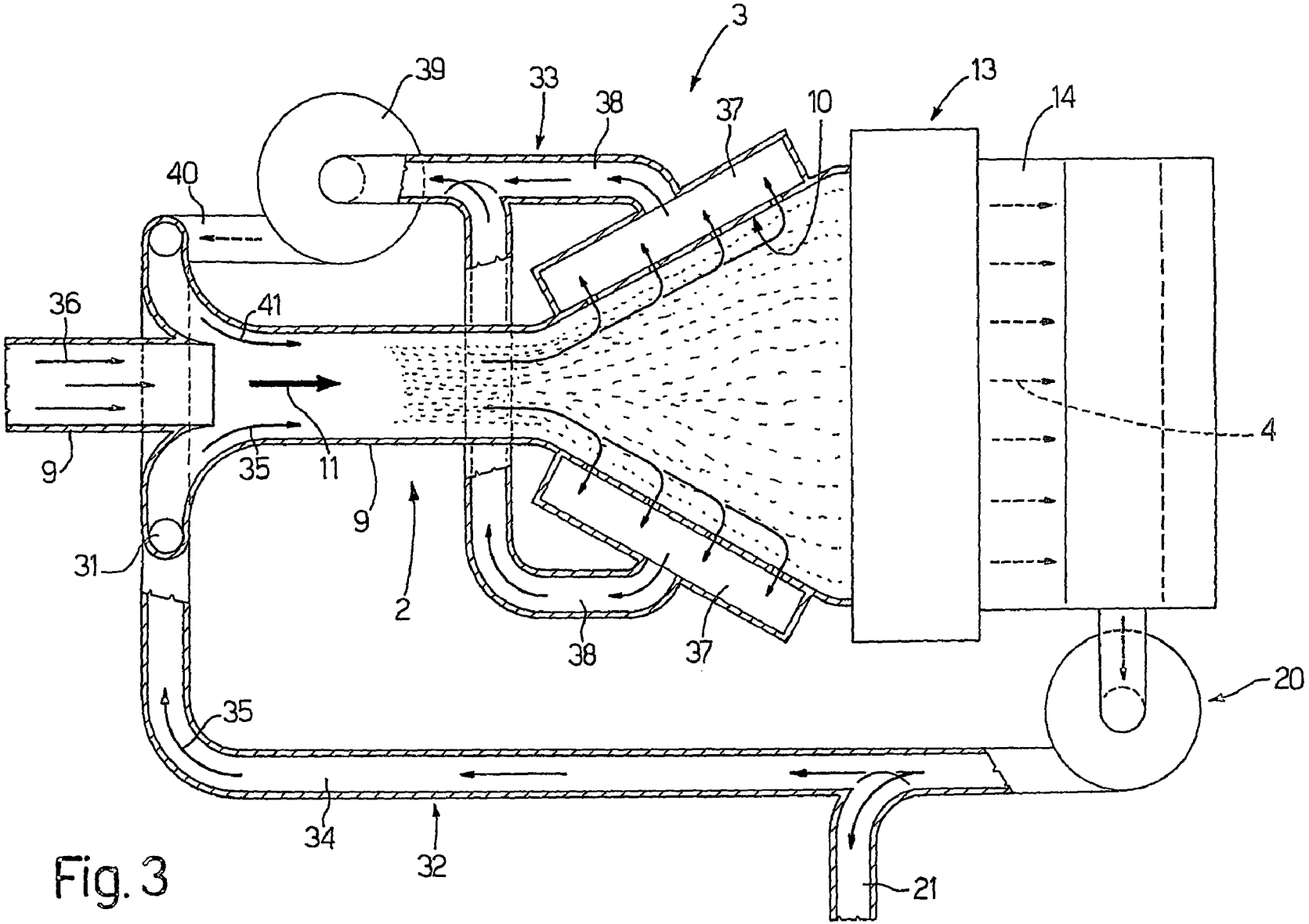
FIG. 3 shows a plan view of the FIG. 2 portion.

As shown in FIGS. 2 and 3, in input unit 3, channel 2 comprises a substantially constant-section input conduit 9 for receiving shredded tobacco stream 4 from a container (not shown), and for feeding it to a flared conduit 10 increasing in section in the flow direction 11 of shredded tobacco stream 4. As shown in FIG. 2, flared conduit 10 is located in series with input conduit 9, and terminates at a node 12 connecting the top end of a cleaning tower 13 to the input end of an output conduit 14 of input unit 3.

Output conduit 14 comprises an input portion, which forms a top extension of cleaning tower 13 and winds about a suction cage 15 rotating about a substantially horizontal axis 16 and shielded partly by a bottom plate 17. Suction cage 15 defines, with its free outer portion, part of the lateral surface of output conduit 14, and is powered so that the part of its surface contacting shredded tobacco stream 4 flowing along output conduit 14 rotates about axis 16 in the same direction as direction 11. At its output end, output conduit 14 is closed by a slide valve 18 rotating about an axis 19 parallel to axis 16.

As shown in FIG. 3, suction cage 15 forms one of the many inputs of a primary-air suction system 20, which comprises a distribution header 21 and, as opposed to forming part of manufacturing machine 1, preferably forms part of a suction system (not shown) of the tobacco plant (not shown) in which manufacturing machine 1 is installed.

As shown in FIG. 2, cleaning tower 13 comprises a substantially sinusoidal upflow channel 22 tapering downwards in section, and a bottom portion of which forms a basin 23 closed at the bottom by a rotary slide dump valve 23*a*. Above basin 23, upflow channel 22 is defined laterally by two lateral walls 24 and 25, of which wall 25 is fixed, while wall 24 is adjustable to and from wall 25 to adjust the section of upflow channel 22. For which purpose, in the example embodiment shown, wall 24 is hinged at 26, is rotated by an actuator 27 about an axis parallel to axis 16, and is fitted at the top with a transverse plate 28 fitted in transversely sliding and fluidtight manner to a seal 29 fitted to one wall of flared conduit 10 at node 12.

Just above basin 23, upflow channel 22 communicates with an intake header 30 for a secondary-air stream 30*a*, which "bubbles" along upflow channel 22 and is preferably pumped along header 30 from the outside. Alternatively, the secondary air may simply be drawn in from outside by the low pressure generated inside cleaning tower 13 by the primary air drawn by suction system 20.

As shown in FIG. 3, along input conduit 9, channel 2 communicates, via an annular header 31, with two different auxiliary pneumatic circuits 32 and 33. Auxiliary pneumatic circuit 32 comprises a conduit 34 branching from distribution header 21 and communicating with annular header 31 to supply flared conduit 10 with an auxiliary-air stream 35, which is mixed with a primary-air stream 36 drawn along input conduit 9 by suction by suction system 20 through suction cage 15; and pneumatic circuit 33 comprises two boxes 37 located on opposite sides of flared conduit 10 and communicating, on one side, with flared conduit 10, and, on the other side, via respective conduits 38, with the inlet of a pump 39, the outlet of which communicates, via a conduit 40, with annular header 31 to supply annular header 31 with a recirculated-air stream 41.

As shown in FIG. 1, in manipulating unit 5, channel 2 comprises a hopper 42 communicating with output conduit 14 via rotary slide valve 18. Shredded tobacco stream 4 is fed by hopper 42 into a box 43 and onto a belt conveyor 44 for feeding shredded tobacco stream 4 to a carding unit 45 housed inside box 43. Carding unit 45 feeds shredded tobacco stream 4 to a vibrating tray 46—also supplied in known manner by an external conveyor 47 with recirculated tobacco obtained, in known manner not shown, by shaving mat 6—and to a gravity conduit 48, the bottom end of which is controlled by a further carding unit 49, which receives the tobacco from gravity conduit 48 and distributes it evenly on a conveyor 50 sloping slightly upwards to the bottom end of an upflow conduit 51 closed at the top end by conveyor belt 7.

The shredded tobacco stream 4 reaching the input of input conduit 9 is therefore substantially all drawn, by the primary-air stream drawn through suction cage 15, onto the underside of conveyor belt 7, to form mat 6, along channel 2, which, as stated, comprises, in succession, input conduit 9, flared conduit 10, output conduit 14, hopper 42, box 43, conveyor 44, tray 46, gravity conduit 48, conveyor 50, and upflow conduit 51. As it flows along channel 2, shredded tobacco stream 4 expands sharply inside flared conduit 10, which has the effect of breaking up any lumps in the tobacco, and of freeing the rest of the tobacco of so-called "heavy" parts defined by any remaining lumps and/or woody tobacco parts and/or foreign bodies.

Expansion is enhanced by supplying further air by means of auxiliary pneumatic circuits 32 and 33, of which at least auxiliary pneumatic circuit 32 may be dispensed with when working with particularly light shredded tobacco.

The heavy parts are eliminated at node 12, by the secondary-air stream flowing from header 30 up along upflow channel 22 allowing the "light" parts in shredded tobacco stream 4 to "float" through node 12 to output conduit 14 and hopper 42, while the heavier parts drop in the opposite direction down upflow channel 22 into basin 23.

Obviously, the specific weight and nature of the parts deposited in basin 23 depend on the speed of the secondary air flowing along upflow channel 22; which speed can be regulated, for a given flow rate along header 30, by actuator 27. In this connection, it should be pointed out that the sinusoidal shape of lateral walls 24 an 25, by producing significant turbulence inside upflow channel 22, not only assists in separating the heavy from the light parts and in feeding the light parts up along cleaning tower 13, but also exponentially enhances the effect of actuator 27 varying the section of upflow channel 22.

Figure 4:
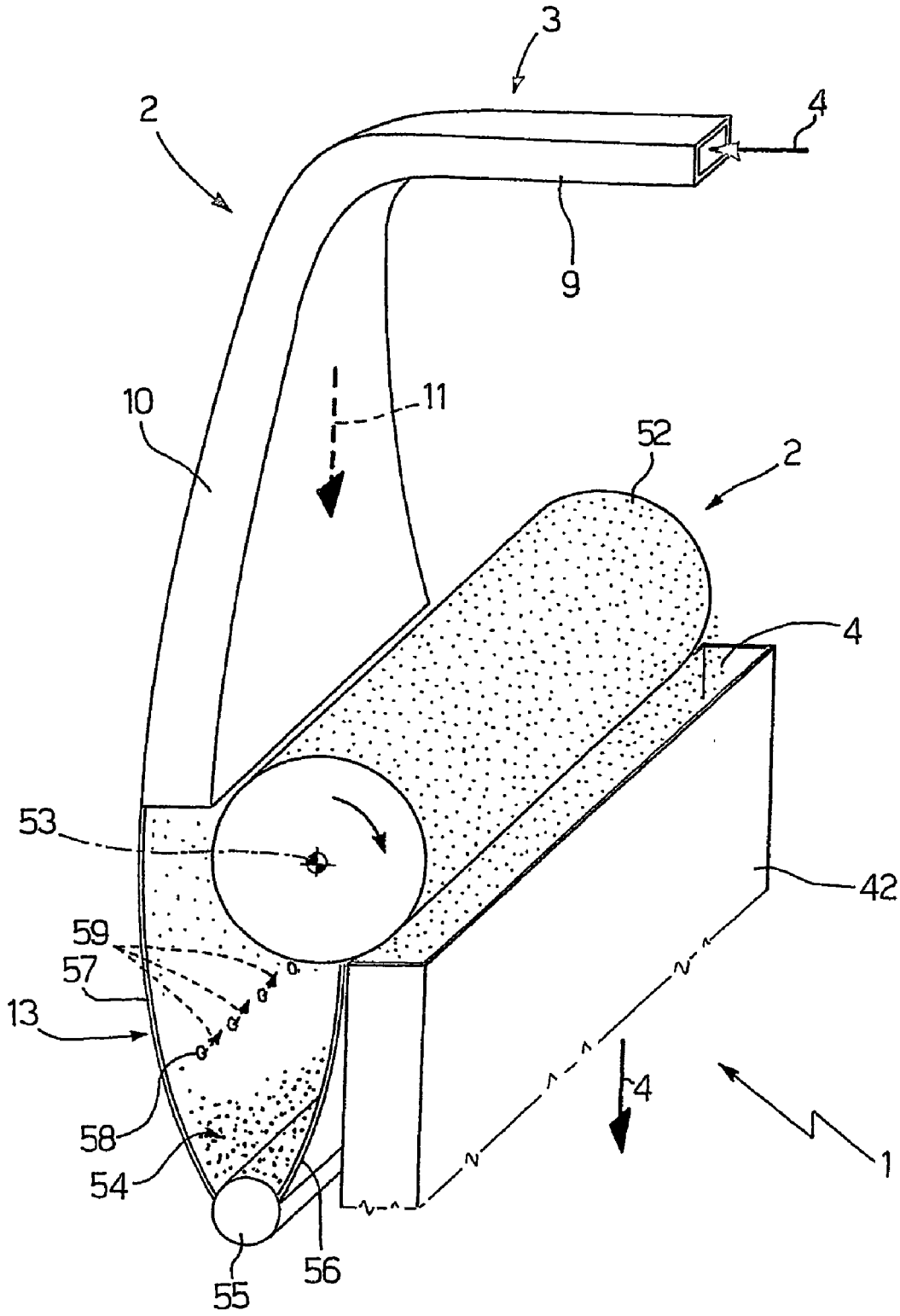
FIG. 4 shows a schematic view in perspective, with parts removed for clarity, of an alternative embodiment of the second portion of the FIG. 1 manufacturing machine.

FIG. 4 shows an alternative embodiment of input unit 3, any parts of which in common with input unit 3 in FIG. 2 are indicated using the same reference numbers. In the FIG. 4 input unit 3, channel 2 comprises a substantially constant-section input conduit 9 for receiving shredded tobacco stream 4 from a container (not shown) and feeding it to a vertical flared conduit 10 increasing in section in the flow direction 11 of shredded tobacco stream 4.

As shown in FIG. 4, flared conduit 10 is located in series with input conduit 9, and comes out inside a vertical cleaning tower 13, which is defined at the top by flared conduit 10 on one side, and, on the other side, by a suction cage 52 rotating about a horizontal axis 53 and connected to primary-air suction system 20. Suction cage 52 rotates clockwise to feed shredded tobacco stream 4 from cleaning tower 13 to hopper 42, which is located beneath suction cage 52 and alongside cleaning tower 13. To assist detachment of shredded tobacco 4 from suction cage 52 into the inlet of hopper 42, suction through suction cage 52 is cut off in known manner at the inlet of hopper 42, which may also be provided with a fixed plate fitted to suction cage 52, and with an air jet directed to detach shredded tobacco 4 from suction cage 52 into the inlet of hopper 42. In an embodiment not shown, a rotary slide valve is provided at the inlet of hopper 42.

Cleaning tower 13 tapers downwards, and is defined at the bottom by a basin 54 closed at the bottom by a rotary slide dump valve 55. Above base 54, cleaning tower 13 is defined laterally by a lateral wall 56 beneath suction cage 52, and by a lateral wall 57 beneath flared conduit 10. Lateral wall 57 has a number of holes 58, through which an air stream 59 is directed to blow shredded tobacco stream 4 from flared conduit 10 to suction cage 52. In an alternative embodiment not shown, lateral wall 56 also has holes for the passage of air stream 59.

As it flows along channel 2, shredded tobacco stream 4 expands sharply inside flared conduit 10, which has the effect of breaking up any lumps in the tobacco, and of freeing the rest of the tobacco of so-called "heavy" parts defined by any remaining lumps, woody tobacco parts, and/or foreign bodies. The heavy parts are eliminated in cleaning tower 13 by force of gravity, so that the "light" parts of shredded tobacco stream 4 are captured by suction cage 52, while the heavier parts drop down along cleaning tower 13 into basin 54. Obviously, the specific weight and the nature of the parts deposited in basin 54 depend on the flow rate and speed of air stream 59 through holes 58 in lateral wall 57.

In other words, in manufacturing machine 1 described, the shredded tobacco stream 4 reaching carding units 45 and 49—of which, carding unit 45 may be dispensed with—is substantially clean and poses no threat to carding units 45 and 49.

Moreover, given the expansion inside flared conduit 10 and the amount of air available through input unit 3 and cleaning tower 13, cleaning of shredded tobacco stream 4 on manufacturing machine 1 is far superior to that achievable, on known manufacturing machines, immediately upstream from upflow conduit 51; and the shredded tobacco stream 4 reaching carding units 45 and 49 is more uniform. Finally, it should be stressed that, in manufacturing machine 1, the shredded tobacco stream 4 flowing along channel 2 is substantially cleaned at the expense of primary air produced in the tobacco plant anyway, and normally for other purposes, outside manufacturing machine 1. Consequently, cleaning shredded tobacco stream 4 on manufacturing machine 1 involves no additional power equipment which is not already provided for, for other purposes, in the tobacco plant.

The above obviously also applies to any machine producing multiple cigarette rods, in which the end portion of channel 2 is defined in known manner by a number of parallel upflow conduits 51 closed at the top by respective conveyor belts 7.

The invention claimed is:

1. A cigarette manufacturing method comprising the steps of:

feeding a shredded tobacco stream (4), on a cigarette manufacturing machine (1), in a given flow direction (11) and along a channel (2) extending through at least one carding unit (49), comprising at least one output portion (51) closed by a suction conveyor belt (7) to form a mat (6) of tobacco on said suction conveyor belt (7), and comprising a hopper (42) connected to said output portion (51) via said carding unit (49); and cleaning, upstream from said output portion (51) and upstream from said carding unit (49) in said flow direction (11), said shredded tobacco stream (4) to remove from the shredded tobacco stream (4) any relatively heavy parts, such as lumps of tobacco and/or woody tobacco parts and/or foreign bodies;

wherein the step of cleaning is performed by feeding the shredded tobacco stream (4) into a vertical cleaning tower (13) defined at the bottom by a basin (54) in which the relatively heavy parts are collected, and at the top by a rotary suction cage (52) rotating about a horizontal axis (53) for feeding the shredded tobacco stream (4) to the hopper (42) which is located beneath the suction cage (52) and alongside the cleaning tower (13).

2. A method as claimed in claim 1, wherein the shredded tobacco stream (4) is fed into the cleaning tower (13) at a top portion of the cleaning tower (13).

3. A method as claimed in claim 1, wherein an air stream (59) is fed into the cleaning tower (13) and so directed as to blow the shredded tobacco stream (4) towards the suction cage (52).

4. A method as claimed in claim 3, wherein the cleaning tower (13) tapers downwards, and is defined laterally by two lateral walls (56, 57), at least one of which has through holes (58) for said air stream (59).

5. A method as claimed in claim 1, wherein, upstream from the cleaning tower (13), the shredded tobacco stream (4) is subjected to an expansion step along a flared portion (10) of said channel (2).

* * * * *